US007921616B2

(12) United States Patent
Reyneveld

(10) Patent No.: US 7,921,616 B2
(45) Date of Patent: Apr. 12, 2011

(54) METHOD AND APPARATUS FOR SETTING SUPPORT COLUMNS WITHIN A FOUNDATION

(76) Inventor: Willy Reyneveld, Bakersfield, CA (US)

( * ) Notice: Subject to any disclaimer, the term of this patent is extended or adjusted under 35 U.S.C. 154(b) by 383 days.

(21) Appl. No.: 12/009,252

(22) Filed: Jan. 16, 2008

(65) Prior Publication Data

US 2009/0178353 A1 Jul. 16, 2009

(51) Int. Cl.
*E02D 27/32* (2006.01)

(52) U.S. Cl. ..... 52/295; 52/297; 52/745.15; 52/745.17

(58) Field of Classification Search ..... 52/745.17, 52/745.18, 741.11, 741.15, 295, 297, 296, 52/298; 264/35, 31
See application file for complete search history.

(56) References Cited

U.S. PATENT DOCUMENTS 4,125,975 A 11/1978 Soble
4,785,593 A * 11/1988 Munoz, Jr. ..... 52/126.1
4,910,930 A * 3/1990 Way ..... 52/167.1
5,152,108 A 10/1992 Madl
5,505,033 A * 4/1996 Matsuo et al. ..... 52/296
5,516,237 A 5/1996 Hebant
5,625,988 A 5/1997 Killick
5,689,927 A 11/1997 Knight, Sr.
6,202,369 B1 3/2001 Partee et al.
6,536,170 B2 3/2003 Stuever
7,003,919 B2 2/2006 Riker
7,596,923 B1 * 10/2009 Thomas et al. ..... 52/741.13

* cited by examiner

*Primary Examiner* — Jeanette E Chapman
*Assistant Examiner* — Daniel Kenny
(74) *Attorney, Agent, or Firm* — James M. Duncan; Klein, DeNatale, Goldne

(57) ABSTRACT

A column support footing, and a method for utilizing the same, allows structural columns to be installed after a cement floor is poured rather than pouring the floor after the columns are set. The column support footing comprises an apparatus which is utilized for setting the column after the concrete floor has been poured. The apparatus comprises a column support sleeve which has an upwardly facing open end for receiving the bottom end of the column. Extending downwardly from the apparatus is an anchor member, which is set within a concrete footing member. The concrete floor may be poured after the first concrete footing member has set around a portion of the anchor member. The concrete floor provides lateral support to the column support sleeve. The column may then be placed and secured within the column support sleeve after the concrete floor has been installed for the structure.

9 Claims, 11 Drawing Sheets

METHOD AND APPARATUS FOR SETTING SUPPORT COLUMNS WITHIN A FOUNDATION

BACKGROUND OF THE INVENTION

The present invention generally relates to a method and apparatus for setting building support columns within a foundation. The present invention more particularly relates to a method and apparatus which provides a secure footing for a support column, where the column may be installed after a concrete floor has been completed rather than the current practice of installing the column and pouring concrete around the column.

It is known in the construction industry to set vertical columns, such as steel columns typically utilized in the construction of various structures, within concrete footings. One known method of preparing the footing for a column is to set a group (usually four) of L-shaped anchor bolts within a first concrete footing member, with threaded ends of the anchor bolts extending above the top of the first footing member, where a nut is disposed on the threads of each anchor bolt. The first concrete footing member typically has steel reinforcement. A flat slab (or section of slab) comprising the floor of the structure is poured after the L-shaped bolts for each of the columns of the structure have been set within a column's respective first footing member. However, forms are constructed around each column footing to isolate the column footing from the slab, forming an area hereinafter referred to as the "blocked out area." The first footing member and the group of upwardly facing anchor bolts within the blocked out area remain exposed after the slab has been poured until later in the construction process as described below.

Once the first concrete footing member around each group of L-shaped anchor bolts has cured, columns having a baseplate attached to the bottom end of each column are attached to the upwardly extending ends of the L-shaped anchor bolts at each footing location. Typically, nuts are first made up on the threads of the L-shaped anchor bolts prior to placing the baseplate and column over the bolts such that the baseplate comes to rest against this first group of nuts as the baseplate is disposed on the anchor bolts and the column set in a vertical orientation. A second nut is thereafter made up on each anchor bolt thereby securing the baseplate to the footing.

Upper structural members or roof members are thereafter attached to the columns. The column and baseplate are leveled as necessary and the space between the first concrete footing member and the bottom of the baseplate is filled in with grout known as "dry pack." An inspection of the column footing is normally required after the baseplate has been grouted.

Once the grout underneath the baseplate has adequately cured, concrete is typically poured into the blocked out area overlying the first footing member, thereby forming a second layer of concrete around the column base and footing. The pouring of the cement slurry in the blocked out area around the column usually occurs after the roof or upper floor structural members have been set in place, often making it difficult to bring large equipment in to pour the cement slurry in the blocked out area. The second layer of concrete surrounds the steel column and completely covers the baseplate and the upwardly extending ends of the L-shaped bolts. The level of the second layer of concrete is generally flush with the surrounding concrete slab.

The method described above for affixing columns to a concrete foundation has some disadvantages. For example, the second layer of concrete in the blocked out area surrounding the columns is visually distinct from the rest of the slab. The boundary lines created by the forms between the surrounding slab and the second concrete layer are clearly visible. Moreover, because of the time span between the pouring of the slab and the second concrete layer, there is a color variation between the concrete slab and the second concrete layer. In structures such as a warehouse, where the slab is not covered with floor coverings, the visible difference between the slab and the concrete adjacent to each column are not as aesthetically pleasing as for a slab surface constructed with a single pour.

As another disadvantage, the pouring of the second concrete layer in the blocked out area requires mobilizing equipment for mixing, delivering, and pouring the concrete. The mobilization of the equipment can be further complicated because of the addition of new members to the structure, such as wall members or roof members, which reduce access of equipment to the blocked out area. It is often necessary to utilized wheel barrows to transport concrete slurry to the blocked out area, resulting in an increase in the time required to pour the second concrete layer.

As another disadvantage, the known system can result in delays while waiting on inspections or waiting for equipment to arrive. For example, an inspection of the dry pack around the bottom of the column is normally required before the second concrete layer can be poured.

An apparatus and method which allows the pouring of the concrete slab and the second concrete layer around the column footings in a single pour would eliminate or reduce the visible differences between the slab and the second concrete footing, reduce mobilization time for concrete equipment, and reduce waiting time required for inspections or equipment. An apparatus and method which enables the baseplate to be leveled without grout would eliminate the time involved in placing the grout, allowing it to set and waiting for inspection.

SUMMARY OF THE INVENTION

The present invention is directed to an apparatus and method which meet the needs identified above for affixing support columns to a foundation. An embodiment of the apparatus comprises a column support footing for receiving and supporting the bottom end of a vertical column of a structure after a concrete floor is poured. The use of embodiments of the column support footing allows an entire concrete floor or slab to be poured before the placement of support columns, which facilitates the construction process and eliminates the need to pour concrete immediately around the base of each column according the known practice.

The column support footing may comprise a column support sleeve which may be integral to or attached to a generally horizontal baseplate having an upward facing side and a groundward facing downward side. The column support sleeve is disposed on the upward facing side of the baseplate. The column support sleeve has an upwardly facing open end for receiving the bottom end of the column. Extending from the downward side of the column support sleeve or the baseplate is an anchor member. A portion of the anchor member is set within a concrete footing member, where the top surface of the concrete footing member is below the baseplate. A second concrete footing member, such as the floor of the structure under construction, is poured after the first concrete footing member has cured around a portion of the anchor member, and the bottom surface of the second footing member overlies at least a portion of the top surface of the first footing member. The second footing member provides lateral support to the column support sleeve, and the level of the second footing member may be configured such that it is flush with the top of the column support sleeve; that is, where the second footing member comprises a floor, the top of the column support sleeve is flush with the surface of the floor. The column may then be placed within the column support sleeve and attached to prevent uplift of the column from the column support sleeve.

Embodiments of this apparatus, and the methods of utilizing the embodiments, allow the pouring of a concrete floor immediately around the column support apparatus without the need to block out an isolated area as currently practiced. When a column is set within the apparatus, the concrete floor is nearly directly adjacent to the column, eliminating the need for an additional pour around the column as currently practiced.

These and other features, aspects, and advantages of the present invention will become better understood with regard to the following description, appended claims, and accompanying drawings.

DETAILED DESCRIPTION OF THE EMBODIMENTS

Prior Art Column Support Footing

Figure 1:
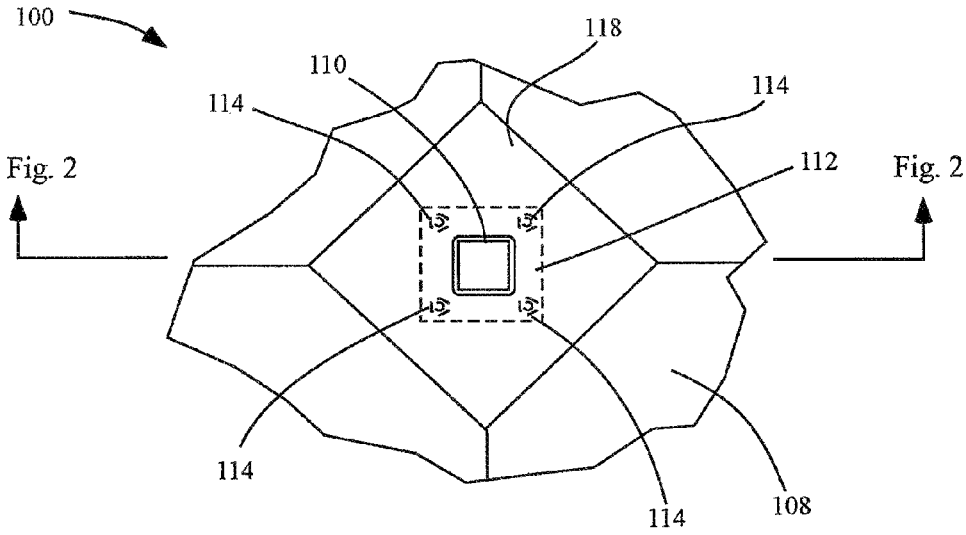
Fig. 1 Prior Art
FIG. 1 is a plan view of a prior art support column and the surrounding support footing.
Figure 2:
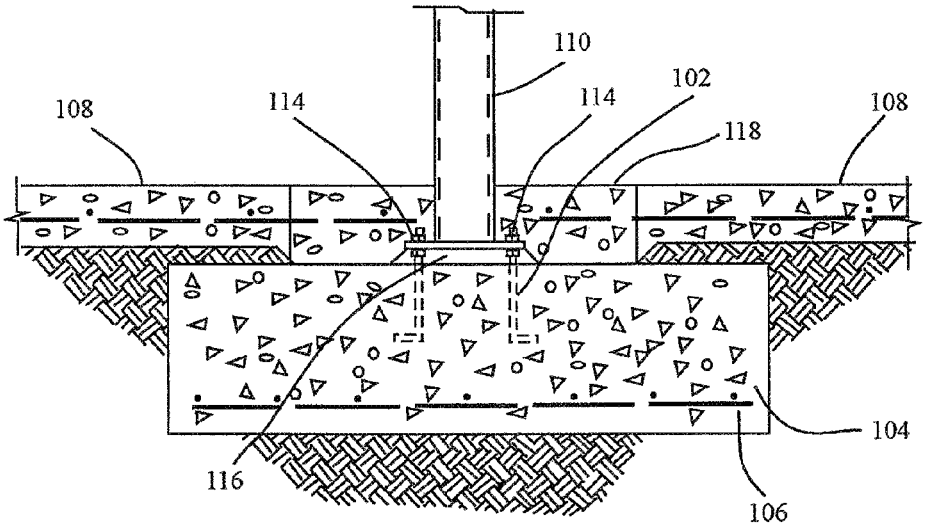
Fig. 2 Prior Art
FIG. 2 is a sectional view of the support column and surrounding support footing shown in FIG. 1.
Figure 3:
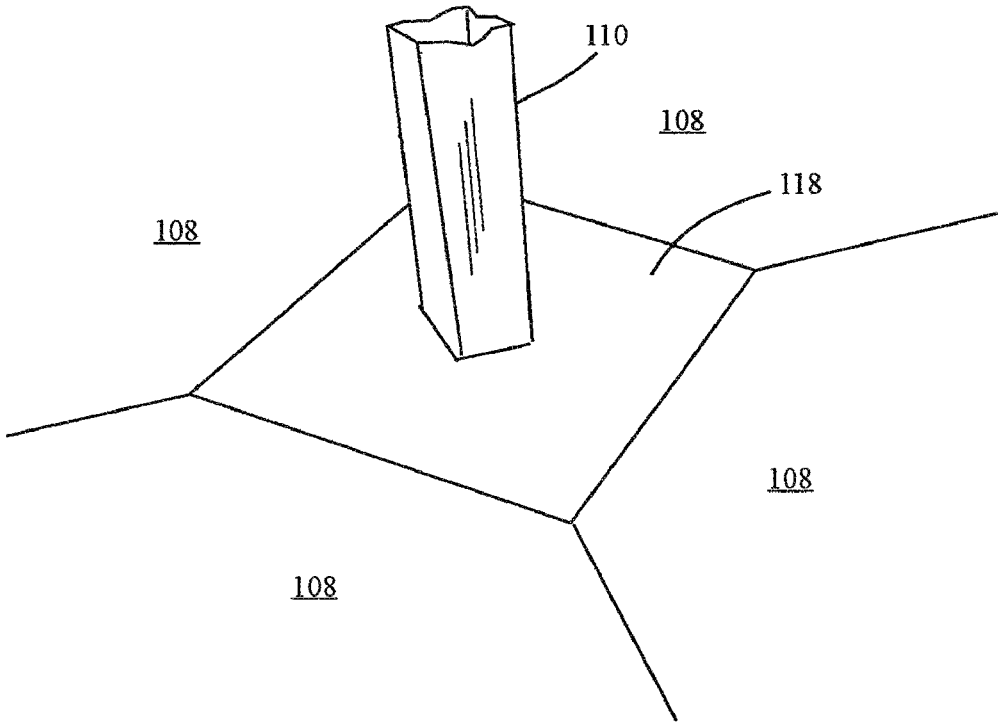
Fig. 3 Prior Art
FIG. 3 is a perspective view of a prior art support column after concrete has been poured around the bottom of the column, showing the visible contrast between the slab and the concrete adjacent to the column footing.

Referring now specifically to the drawings, FIGS. 1 through 3 show a prior art column support footing 100. The prior art column support footing 100 is prepared by setting anchor bolts 102 within a first concrete footing member 104, which typically comprises steel reinforcement members 106. The anchor bolts 102 are typically L-shaped and threaded on the upward facing end of the bolt, with a nut made up on each threaded end. Because the columns secured by the footing are often utilized to support roofs, the column support footing 100 includes features, such as an L-shape, to prevent uplift of the column. Otherwise, if the roof of the structure experiences conditions which cause lift, such as high winds, the column might lift from the concrete footing. An area around the column support footing 100 is blocked out with forms defining an area, typically square or rectangular, immediately adjacent to the anchor bolts 102. Once the forms have been placed, floor slab 108 may be poured, however, cement is not at this time poured in the blocked area immediately adjacent to the column support footing 100 to bring the level flush with the floor slab 108.

Once the first concrete footing member 104 has sufficiently cured around anchor bolts 102, a column 110 comprising a baseplate 112 may be set upon the anchor bolts, with the baseplate supported by the nuts previously made up on the bolts. A second set of nuts 114 is thereafter made up on anchor colts 102 to secure the baseplate 112 and attached column 110. After the columns 110 for the structure are installed, other structural members for the building are typically installed, such as roof members, trusses, walls, etc., with level adjustments made to each column 110 by adjusting the nuts 114 below the baseplate 112. Once the column 110 has been leveled as necessary, grout 116 in the form of dry pack is disposed in the spaced defined by the bottom of the baseplate 112 and the top of the first concrete footing member 104.

Once the columns 110 have been placed, concrete is poured in the blocked area around the column support footing forming thereby forming secondary slab 118 around each column 110. As indicated by FIGS. 1 and 3, the secondary slab 118 appears separate and discrete from the floor slab 108.

Embodiments of the Invention

FIGS. 4 through 7 show an embodiment 200 of the presently disclosed column support footing. As with the prior art column support footing 100 discussed above, this embodiment 200 is prepared by setting anchor bolts 202 within a first concrete footing member 204, which typically comprises steel reinforcement members 206. As with the prior art, the anchor bolts 202 are typically L-shaped and threaded on the upward facing end of the bolt, with a nut made up on each threaded end.

Figure 6:
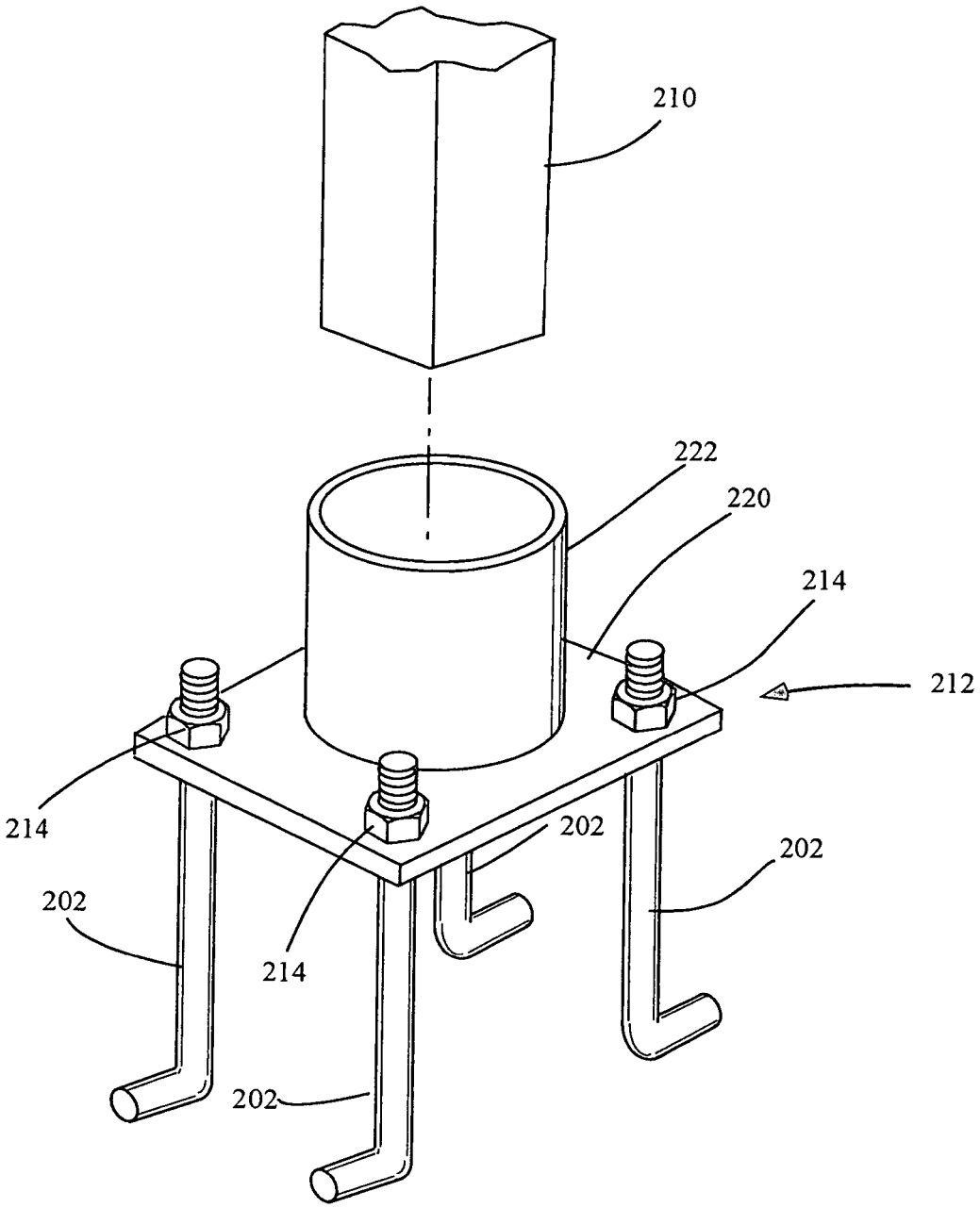
FIG. 6 is a perspective view of an embodiment of a column support apparatus utilized in the disclosed invention.

Once the first concrete footing member 204 has sufficiently cured around anchor bolts 202, a generally horizontal baseplate 212 is set over the anchor bolts, with the bottom of the baseplate supported by nuts 214 which have been made up on the threads of the anchor bolts. A second set of nuts 214 are attached to the anchor bolts 202 and made up against the upward facing side 220 of the baseplate 212. The baseplate 212 comprises a column support sleeve 222 on the upward facing side 220 where the column support sleeve has an upwardly facing open end for receiving the bottom end of a column 210. As shown in FIG. 6, the opening of the column support sleeve 222 is preferably circular or round for receiving the bottom end of a rectangular or square column 210.

Once the baseplate 212 and column support sleeve 222 have been set on the anchor bolts 202, the baseplate 212 is leveled as necessary and grout 216 in the form of dry pack is disposed in the spaced defined by the bottom of the baseplate 212 and the top of the first concrete footing member 204.

Once the grout 216 is set, concrete floor 208 is poured, including the pouring of cement over the baseplate 212 and around the column support sleeve 222, such that the concrete overlies all or a portion of the first concrete footing member 204 in which the anchor bolts 202 have been set, and the cement surrounds column support sleeve 222. It is to be appreciated that concrete floor 208 is poured such that it is immediately adjacent to where the base of column 210 will eventually be placed, rather than blocked off as in the prior art method described above, such that the concrete floor 208 provides lateral support to the column support sleeve 222, and thus will support column 210 when it is placed within the column support sleeve. Concrete floor 208 may thus be considered to be a second concrete footing member. It is also to be appreciated that a temporary cap or insert should be placed within column support sleeve 222 to prevent concrete from spilling or falling inside the sleeve.

Figure 7:
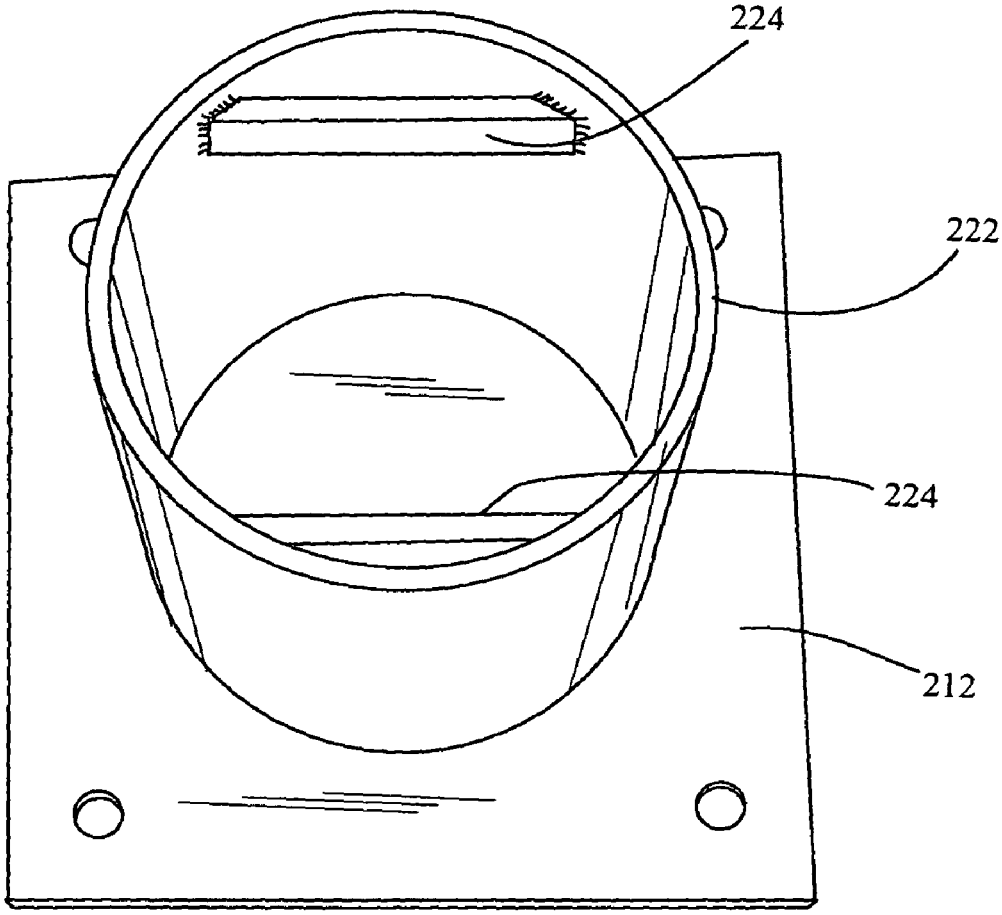
FIG. 7 is a perspective view of an embodiment of a column support sleeve utilized in the disclosed invention.

Once the concrete floor 208 has cured around the column support sleeve 222, the bottom end of column 210 may be inserted into the column support sleeve. In order to prevent uplift of the column 210, attachment means are utilized for attaching the column support sleeve 222 to the bottom end of the column 210. For example, as best shown in FIG. 7, retainer plates 224 may welded to the inside of column support sleeve 222. The bottom end of column 210 may be welded to the retainer plates 224 and/or to the column support sleeve 222. The remaining space between the inside of the column support sleeve 222 and the bottom of the column 210 may be filled as desired with concrete, grout or other suitable filling material. A grout having low viscosity has been found to work well in filling the interstitial space between the column 210, column support sleeve 222, and retainer plates 224.

Figure 8:
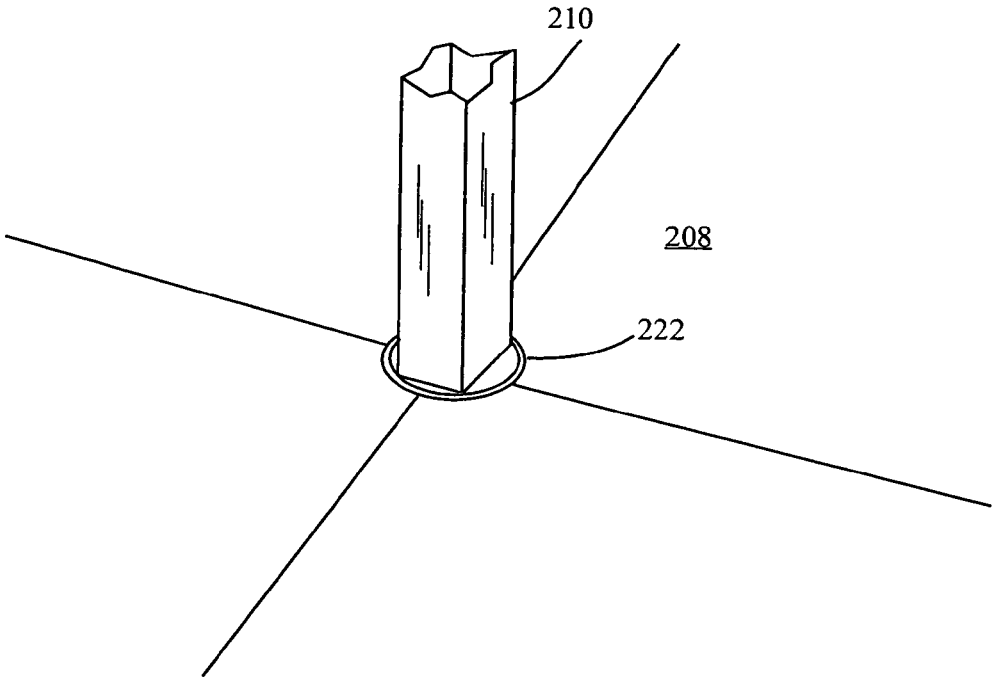
FIG. 8 is a perspective view of a support column according to the present invention after concrete has been poured around the bottom of the column, showing the elimination of the contrasting features and dividing lines shown in FIG. 3.

FIG. 8 depicts a column installed with an embodiment of the disclosed column support footing. The use of the disclosed column support footing allows an entire concrete floor to be poured prior to the placement of the support columns. As shown by comparing FIG. 8 to FIG. 3, use of the disclosed column support footing eliminates the need to make a separate concrete pour immediately adjacent to the column 210, resulting in an installation which has greater visual appeal but requires less time to install.

Figure 9:
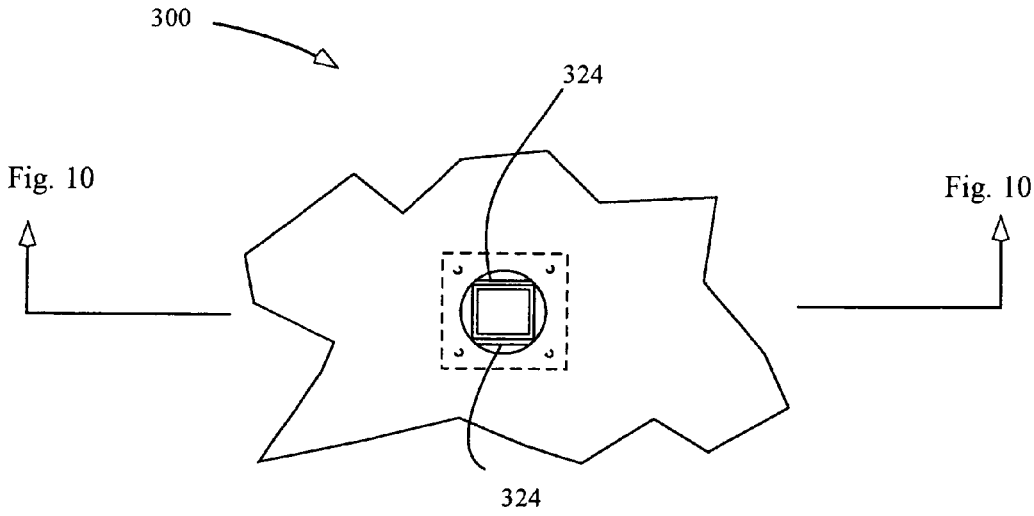
FIG. 9 is a plan view of another embodiment of a column support footing according to the present invention in which grout is not required for leveling of the baseplate.
Figure 10:
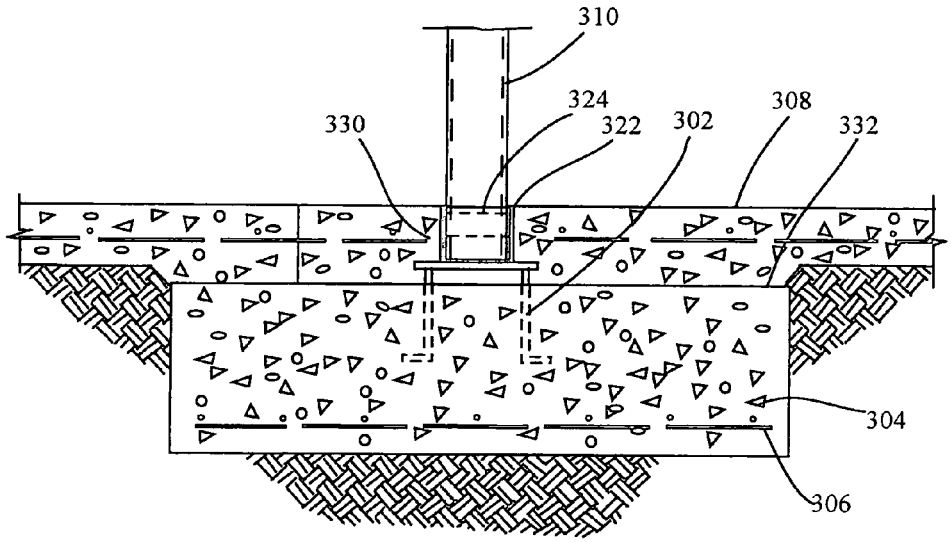
FIG. 10 is a sectional view of the support column and surrounding support footing shown in FIG. 10.
Figure 11:
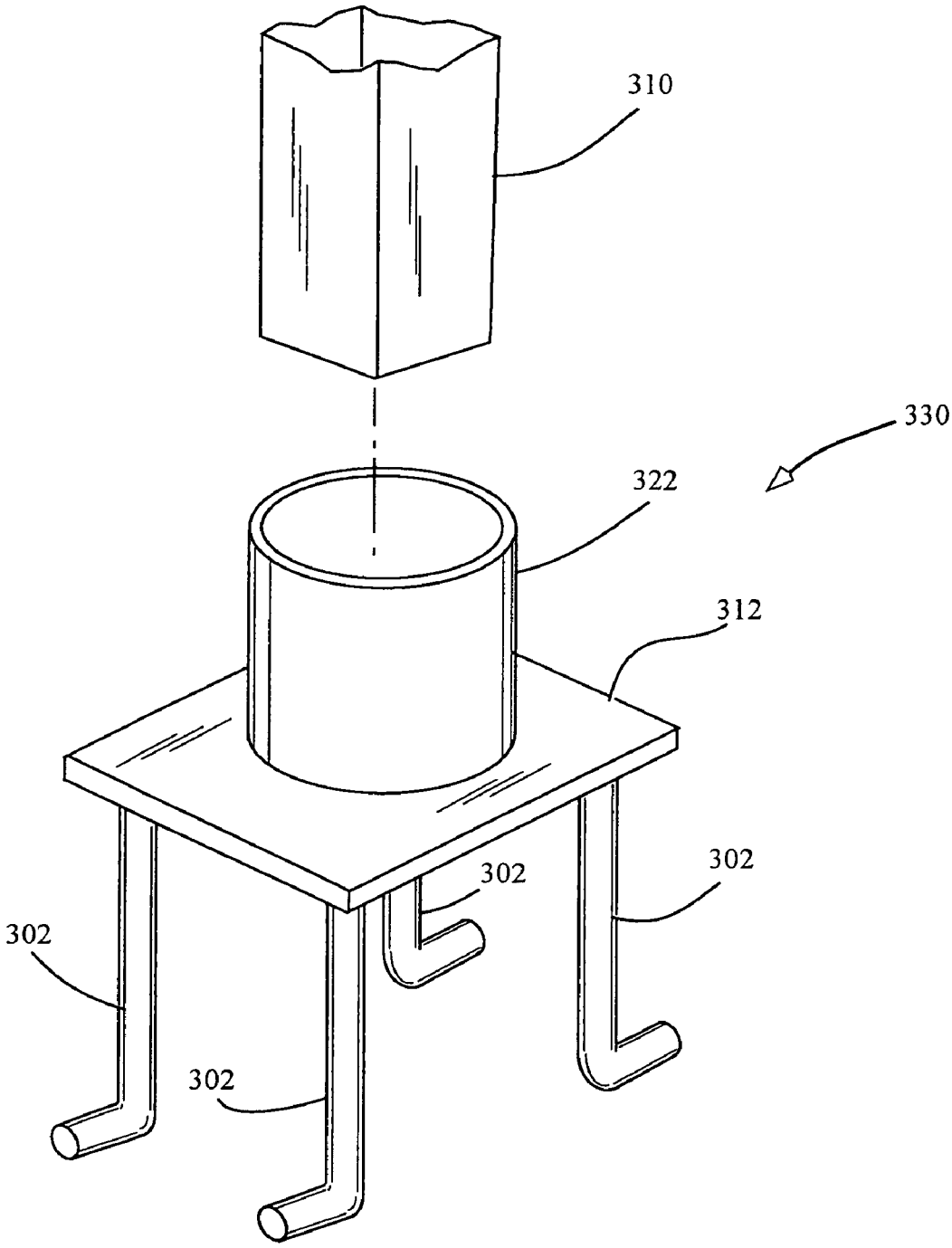
FIG. 11 is a perspective view of an embodiment of a column support apparatus utilized in the disclosed invention.

FIGS. 9 through 11 shown another embodiment 300 of the presently disclosed column support footing. This embodiment 300 utilizes the column support apparatus 330 shown in FIG. 11 which may comprise a baseplate member 312 having an upward facing side 320 and a groundward facing downward side, the baseplate member 312 comprising a column support sleeve 322 on the upward facing side. The column support sleeve 322 has an upwardly facing open end for receiving the bottom end of a column 310. It is to be appreciated that an embodiment of the column support apparatus may comprise a column support sleeve 322 without a baseplate member 312, or baseplate member substantially reduced in size.

The column support apparatus 330 further comprises at least one anchor member 302 extending downwardly from the downward side of the baseplate member 312 or, alternatively, from the column support sleeve 322. The anchor member 302 may be in the form of an "L" to prevent uplift of the anchor from the concrete footing. Although four anchor members 302 are depicted in FIG. 11, it is to be appreciated that a different number of anchor members may be utilized, and that the shape of the anchor member may vary, although the shape of the anchor should be configured to resist uplift of an anchor set within a concrete footing.

Column support footing 300 further comprises a concrete footing member 304 into which the anchor members 302 of column support apparatus 330 are set. Concrete footing member 304 typically comprises steel reinforcement members 306. The concrete footing member 304 encases a portion of the anchor members 302, but the top surface 332 of the concrete footing member is below the downward facing side of the baseplate member 312, as shown in FIG. 10. It is to be appreciated that because the column support sleeve 322 is a single unit with the anchor members 302, the column support sleeve in this embodiment of the column support footing should be in a level position when the concrete footing member 304 is poured. In that regard, an apparatus is disclosed in FIGS. 12 and 13 which may be utilized, with a laser leveling devices, for setting and maintaining the column support apparatus 330 in a level position until concrete footing member 304 sets.

Once the first concrete footing member 304 has sufficiently cured around anchor members 302, concrete floor 308 is poured, including the pouring of cement over the baseplate member 312 and around the column support sleeve 322, such that the concrete floor 308 directly overlies all or a portion of the first concrete footing member 304 in which the anchor members 302 have been set, and the cement surrounds column support sleeve 322. It is to be appreciated that concrete floor 308 is poured such that it is immediately adjacent to where the base of column 310 will eventually be placed, rather than blocked off as in the prior art method described above, such that the concrete floor 308 provides lateral support to the column support sleeve 322, and thus will support column 310 when it is placed within the column support sleeve. Concrete floor 308 may thus be considered, with respect to the column 310, as a second concrete footing member which overlies all or a portion of the first concrete footing member 304. It is also to be appreciated that a temporary cap or insert should be placed within column support sleeve 322 to prevent concrete from spilling or falling inside the sleeve.

Once the concrete floor 308 has cured around the column support sleeve 322, the bottom end of column 310 may be inserted into the column support sleeve. In order to prevent uplift of the column 310, attachment means are utilized for attaching the column support sleeve 322 to the bottom end of the column 310. For example, retainer plates 324 may welded to both the column support sleeve and to the bottom end of column 310, or the column may be welded directly to the column support sleeve. The remaining space between the inside of the column support sleeve 322 and the bottom of the column 310 may be filled as desired with concrete or grout.

It is to be appreciated that the embodiment 300 of the column support footing shown in FIGS. 9 through 11 eliminates the need for separately leveling the baseplate or applying grout to fill the space between the top of the top surface 332 of the concrete footing member 304 and the downward facing side of the baseplate member 312. In this embodiment 300, leveling of the column support apparatus 330 occurs prior to the pouring of the concrete footing member 304 and the space between the top surface 332 of the concrete footing member 304 and the downward facing side of the baseplate member is filled when concrete floor 308 is poured. This embodiment is referred to as the "wet set" column support footing.

Figure 12:
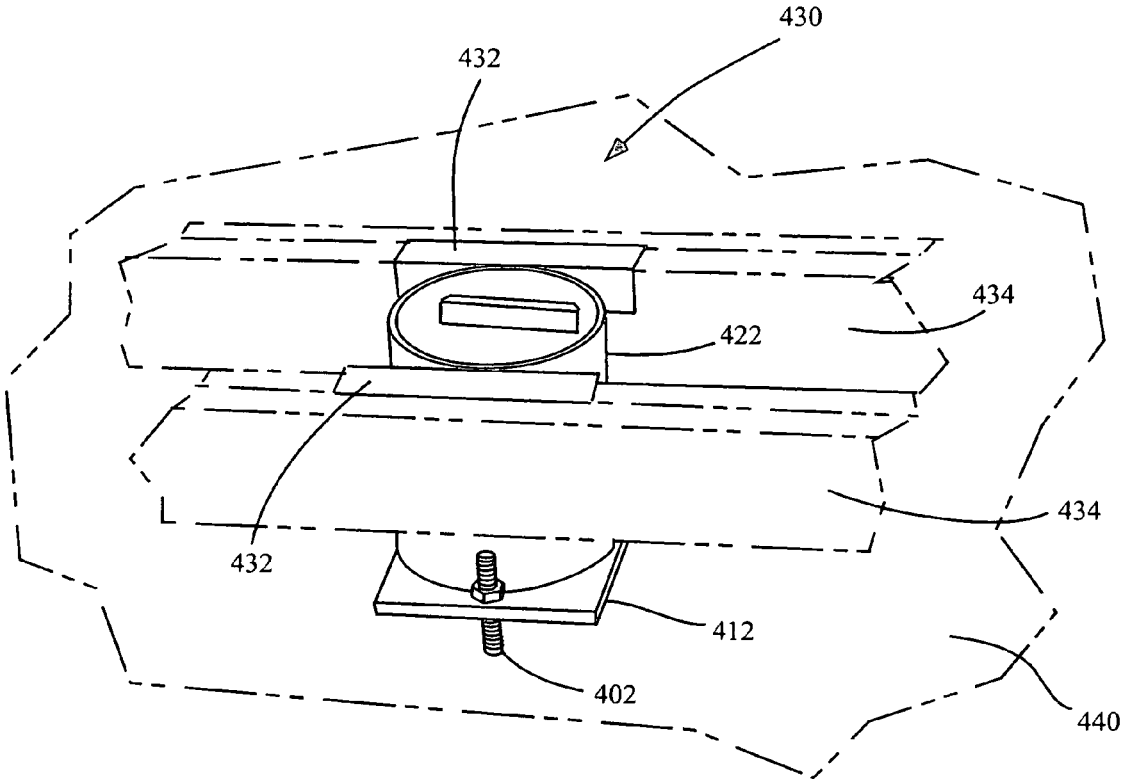
FIG. 12 is a side view showing an embodiment of a column support apparatus and an assembly utilized to level the baseplate and column support sleeve prior to pouring the first concrete footing member, thereby eliminating the need to level the baseplate with grout.
Figure 13:
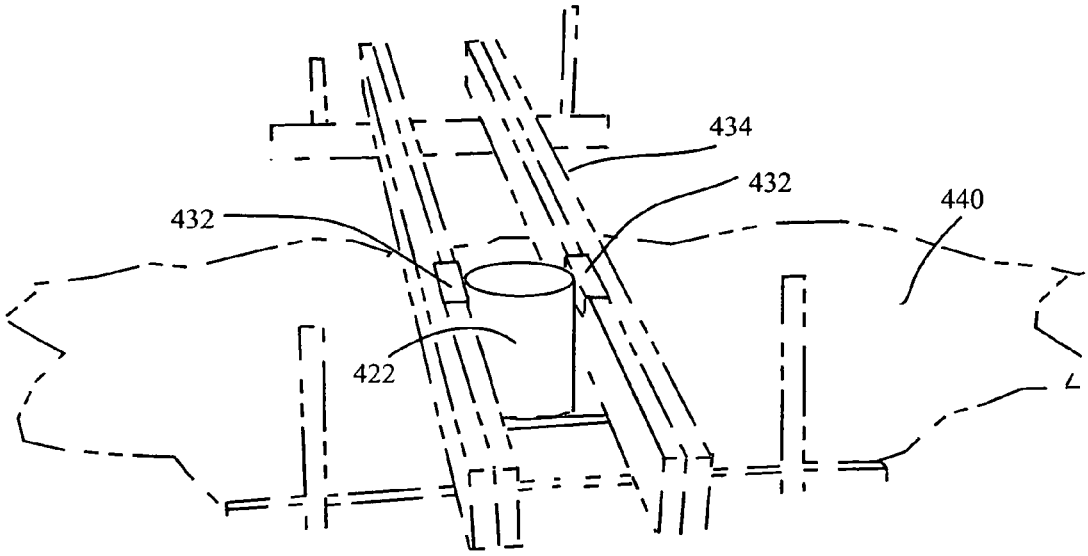
FIG. 13 is front view of the column support apparatus and assembly shown in FIG. 12.
Figure 14:
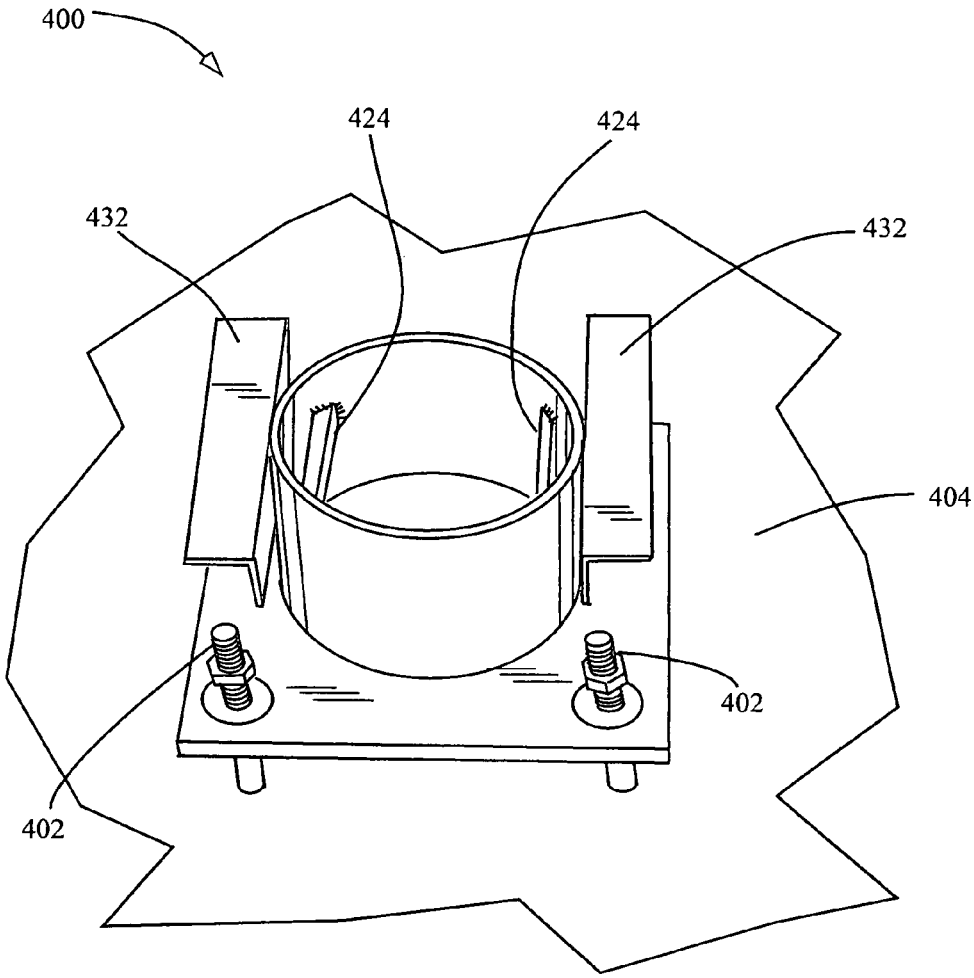
FIG. 14 shows the baseplate assembly of FIG. 12 after the first concrete footing member has been poured and the leveling assembly removed.

FIGS. 12 through 13 show an apparatus utilized for leveling embodiments of the disclosed column supporting footing. While these figures show an embodiment which utilizes anchor bolts 402 and a separate baseplate 412, it is to be appreciated that the leveling apparatus might be utilized with an embodiment comprising a column support apparatus 330 as shown in FIGS. 9 through 11. As shown in FIG. 14, the column support sleeve 422 may comprise support hangers 432 which are utilized to support the baseplate 412, column support sleeve, and anchor bolts 402 from support members 434. The support hangers 432, which may be configured as angle pieces as shown in FIG. 14, may be tangentially attached to the exterior of the column support sleeve 422.

As shown in FIG. 13, support members 434 span across the area in which a concrete footing member 404 is poured. Prior to the pouring of concrete footing member 404, a laser leveling device may be utilized to insure that the column support sleeve 422 is level and vertically aligned for receiving a column.

FIG. 14 shows an embodiment 400 of the column support footing after concrete footing member 404 has been poured and the leveling apparatus removed. Once the concrete footing member 404 is set, a concrete floor may be poured, which surrounds and provides lateral support to column support sleeve 422. A column may than then be set within the column support sleeve 422, welded in place utilizing retainer plates 424 for securing the column to the column support sleeve.

The embodiments of the disclosed apparatus may be utilized in a method of setting a vertical column within a footing which allows the pouring of a concrete floor prior to the installation of the columns. The method has the further advantage of eliminating a subsequent concrete pour around the base of a column to cover the column base and footing.

Figure 4:
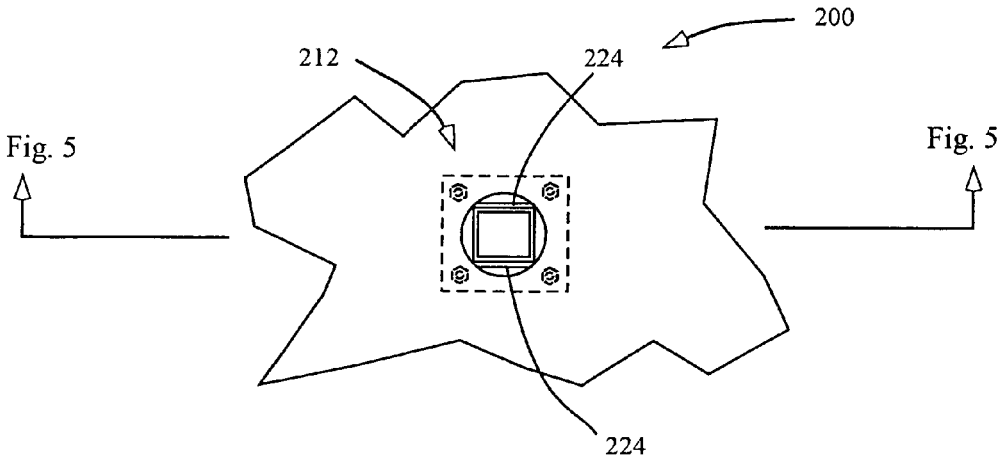
FIG. 4 is a plan view of an embodiment of a column support footing according to the present invention.
Figure 5:
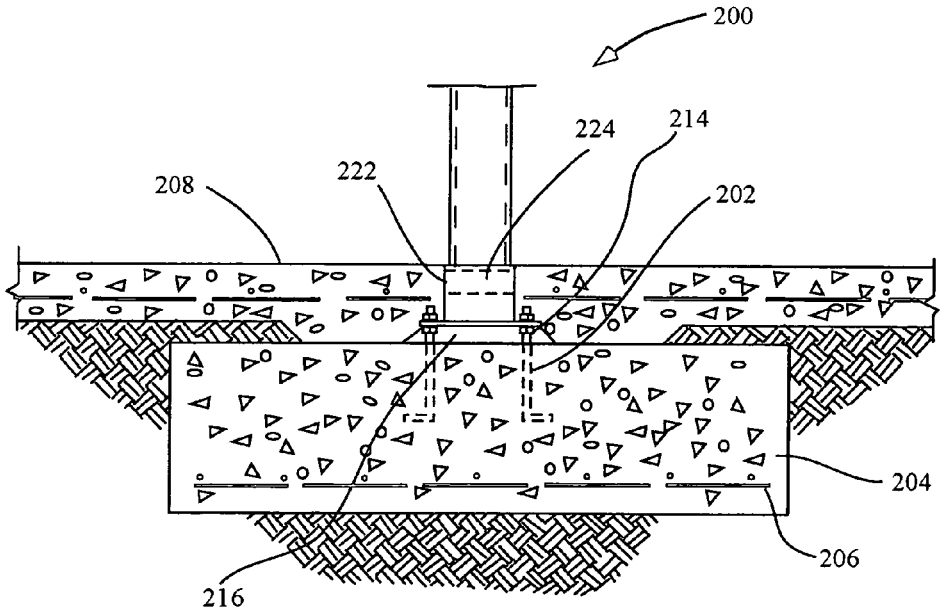
FIG. 5 is a sectional view of the support column and surrounding support footing shown in FIG. 4.

An embodiment of the method, which may utilize embodiments of the apparatus shown in FIGS. 4 through 6, comprises the steps of pouring a first concrete footing 204 around a plurality of anchors 202, where a portion of each anchor extends above the top of the footing. Sufficient time is allowed for the concrete footing to cure. Once the concrete has cured, baseplate 212 is set over the anchors 202, where the bottom of the baseplate is supported by nuts 214. Baseplate 212 comprises a column support sleeve 222 disposed on the upwardly facing side of the baseplate, where the column support sleeve comprises an upwardly facing opening. The baseplate 212 and column support sleeve 222 are leveled, where the level may be adusted by the nuts 214 upon which the baseplate is supported. Once the baseplate 212 and column support sleeve are level, the concrete floor 208 or slab may be poured, such that the column support sleeve is surrounded by concrete. Alternatively, the space defined between the bottom of the baseplate and the top surface of the first concrete footing 204 may be filled with grout 216 such as dry pack.

Once the cement of the concrete floor 208 adequately sets, the bottom end of column 210 may be inserted into column support sleeve 222 and secured with fastening or attachment means, such as welding or threaded fasteners.

An embodiment of the method, which may utilize embodiments of the apparatus shown in FIGS. 9 through 14, comprises the steps of digging a footing excavation 440 and assembling a support assembly 450, such as that shown in FIGS. 12 and 13, over the excavation. A column support apparatus 430 is placed upon the support assembly 450. The column support apparatus 430 may comprise support hangers 432 which depend from support members 434, which span across the excavation and are secured at either side. A first concrete footing 404 is poured around the anchors 402, where a portion of each anchor extends above the top of the concrete footing. Sufficient time is allowed for the concrete footing 404 to cure. The column support apparatus may then be removed, and the concrete floor poured, where the concrete surrounds the sides of the column support sleeve 422. Once the concrete floor is poured, a column support footing such as that depicted in FIG. 10 is formed. In accord with FIG. 10, the bottom of the column 310 may then be inserted into column support sleeve 322 and secured with retaining means.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A column support footing for receiving and supporting the bottom end of a square column, the column support footing comprising:

a cylindrical column support sleeve comprising an upwardly facing circular open end for receiving the bottom end of the column, and a lower end attached to a baseplate, the baseplate comprising an upward side and a downward side;

at least one anchor member extending downward from the downward side of the baseplate; and a sequentially poured plurality of concrete footing members comprising a first footing member and a second footing member, the first footing member encasing a portion of the anchor member, the first footing member having a top surface below the downward side of the baseplate, and the second footing member providing lateral support to the column support sleeve, the second footing member having a bottom surface overlying at least a portion of the top surface of the first footing member and an upper surface laterally adjacent to the open end of the cylindrical column support sleeve wherein the cylindrical column support sleeve comprises a plurality of interior attachment members having an axial location within the column support sleeve which is below the upper surface of the second footing member, wherein the bottom end of the square column, when received by the column support sleeve, is supported by the interior attachment members.

2. The column support footing of claim 1 wherein the anchor member is configured in an L shape.

3. The column support footing of claim 1 wherein the anchor member comprises an L-shaped anchor bolt.

4. The column support footing of claim 1 wherein the column support footing comprises four L-shaped anchor bolts.

5. A method of setting a square column within a footing, the method comprising the steps of:

pouring a first concrete footing around a plurality of anchor members, where a portion of each anchor member extends above the top of the first concrete footing;

allowing sufficient time for the concrete footing to cure;

setting a baseplate over the anchor members, the baseplate comprising a flat plate having an upwardly facing side and a downwardly facing side, the upwardly facing side comprising a cylindrical column support sleeve disposed on the upwardly facing side, the column support sleeve comprising sides defining an upward facing circular opening wherein the cylindrical column support sleeve further comprises a plurality of interior attachment members having an axial location within the column support sleeve;

leveling the baseplate and securing the baseplate to the anchor members;

pouring a second concrete footing, the second concrete footing surrounding the sides of the cylindrical column support sleeve, the second concrete footing comprising an upper surface laterally adjacent to the open end of the cylindrical column support sleeve, the upper surface above the axial location of the interior attachment members;

inserting the bottom end of the square column within the upward facing circular opening of the column support sleeve; and attaching the bottom end of the square column to the cylindrical column support sleeve by attaching the bottom of the column to the interior attachment members.

6. The method of claim 5 wherein each anchor member is configured into an L-shape.

7. The method of claim 5 wherein each anchor member comprises an L-shaped anchor bolt.

8. The method of claim 5 wherein a first space is defined by the downwardly facing side of the baseplate and the top of the first concrete footing.

9. The method of claim 8 further comprising the step of disposing dry pack in the first space.

* * * * *